US006923337B2

(12) United States Patent
Hession et al.

(10) Patent No.: US 6,923,337 B2
(45) Date of Patent: Aug. 2, 2005

(54) DRINKING CONTAINER

(75) Inventors: John A. Hession, Braintree, MA (US); James J. Britto, Westport, MA (US)

(73) Assignee: The First Years Inc., Avon, MA (US)

( * ) Notice: Subject to any disclaimer, the term of this patent is extended or adjusted under 35 U.S.C. 154(b) by 85 days.

(21) Appl. No.: 10/648,974

(22) Filed: Aug. 27, 2003

(65) Prior Publication Data

US 2005/0045647 A1 Mar. 3, 2005

(51) Int. Cl.[7] ..... A47G 19/22
(52) U.S. Cl. ..... 220/714; 215/388; 220/717
(58) Field of Search ..... 220/717, 703, 220/705, 711–716, 729, 906; 215/387, 388

(56) References Cited

U.S. PATENT DOCUMENTS

| | | | | |
|---|---|---|---|---|
| D165,778 | S | 1/1952 | Olsen | |
| 3,208,629 | A | 9/1965 | Beeson | |
| 3,739,938 | A * | 6/1973 | Paz | 220/715 |
| 4,184,604 | A | 1/1980 | Amberg et al. | |
| 4,238,045 | A | 12/1980 | D'Andria | |
| 4,245,752 | A | 1/1981 | Prueher | |
| 4,946,062 | A | 8/1990 | Coy | |
| 5,150,816 | A | 9/1992 | DeCastro | |
| 5,706,972 | A | 1/1998 | Sousa | |
| 6,062,419 | A | 5/2000 | Krüger et al. | |
| 6,116,458 | A | 9/2000 | Dark | |
| 6,135,311 | A | 10/2000 | Panec et al. | |
| 6,202,877 | B1 | 3/2001 | La Torre et al. | |
| 6,264,166 | B1 | 7/2001 | Bowland et al. | |
| 6,276,560 | B1 | 8/2001 | Belcastro | |
| 6,305,570 | B1 * | 10/2001 | Atkin et al. | 220/714 |
| 6,325,236 | B1 * | 12/2001 | Wong | 220/713 |
| 6,471,101 | B1 * | 10/2002 | Vardanyan | 222/541.2 |
| 6,568,557 | B2 * | 5/2003 | Fusco et al. | 220/714 |
| 6,758,364 | B1 * | 7/2004 | Rohrig | 220/714 |
| 6,786,352 | B2 * | 9/2004 | Belcastro | 220/714 |
| 2002/0066741 | A1 | 6/2002 | Rees | |

FOREIGN PATENT DOCUMENTS

| | | |
|---|---|---|
| WO | WO02/11587 A1 | 2/2002 |

* cited by examiner

*Primary Examiner*—Lien M. Ngo
(74) *Attorney, Agent, or Firm*—Fish & Richardson P.C.

(57) ABSTRACT

A drinking valve assembly includes an inner member with an aperture and an outer member with a movable drinking spout extending from an upper surface of the outer member. The inner member and the outer member of the drinking valve assembly form a channel extending from the aperture to a spout outlet. The outer member has an inner surface that contacts the inner member about the aperture to block flow along the channel with the spout in a first position, the inner surface of the outer member being displaced from the inner member in response to movement of the spout to a second position to enable flow along the channel.

66 Claims, 11 Drawing Sheets

DRINKING CONTAINER

TECHNICAL FIELD

This invention relates to drinking containers and more particularly to flow valves and lids for use with drinking containers and methods of their use.

BACKGROUND

Drinking containers with lids are frequently used to reduce the potential for accidental spillage of the contents of the container. Persons of various ages and stages of physical development, from younger children to older adults, use various types of lidded drinking containers that are selected based on, e.g., their individual needs and/or tastes. Some of these lidded drinking containers include valve assemblies. Some valve assemblies, however, may restrict the rate of flow of the liquid to unsatisfactory levels. Additionally, individual needs and/or tastes may change, e.g., due to a change in physical development, physical activity, type of drink, etc. Thus, when a particular drinking container is no longer desirable, it becomes necessary to replace at least the lid and possibly the entire drinking container.

SUMMARY

One aspect of the invention features a drinking valve assembly including an inner member that has an aperture and an outer member that includes a movable drinking spout extending from an upper surface of the outer member. A channel is formed by the inner and outer members that extends from the aperture to a spout outlet. The outer member has an inner surface that contacts the inner member about the aperture to block flow along the channel with the spout in a first position, the inner surface of the outer member being displaced from the inner member in response to movement of the spout to a second position to enable flow along the channel.

In some cases, the drinking valve assembly further includes an outer wall configured to receive the inner member and position the inner member adjacent the outer member such that the inner surface of the outer member contacts the inner member with the spout in the first position to block flow along the channel. In certain applications, the inner member includes a flange configured to seat against a stop extending inwardly from the outer wall, the stop positioned along the outer wall such that the inner member, when seated against the stop, contacts the inner surface of the outer member with the spout in the first position to block flow along the channel.

In some embodiments, the outer member is constructed to resiliently deform as the movable drinking spout is moved from the first position to the second position. In certain cases, the movable drinking spout moves a distance from at least about one degree to about 45 degrees, such as about three degrees from the first position to the second position to enable flow along the channel.

In some cases, the outer member defines a vent spaced-apart from the movable spout to enable air to pass therethrough and into the channel with the spout in the second position.

In certain applications, the inner surface that contacts the inner member is formed by a circular sealing ridge that extends outwardly from the inner surface of the outer member and is arranged to circumscribe the aperture of the inner member.

In another aspect, the invention features a method of adjusting flow rate of a drinking container valve. The method includes providing the above drinking valve assembly having a removable inner member, removing the inner member defining the aperture, the inner member providing a first flow rate through the spout outlet with the movable spout in the second position and replacing the inner member with a second inner member having an aperture, the second inner member providing a second flow rate through the spout outlet with the movable spout in the second position different from the first flow rate provided by the aperture of the removed inner member.

In some embodiments, the second inner member is removable and may be replaced with a third inner member having an aperture, the third inner member providing a third flow rate through the spout outlet with the movable spout in the second position different from the flow rates provided by the removed inner members.

In another aspect, the invention features a drinking valve assembly including an inner member defining an aperture to allow fluid to pass therethrough, a channel extending from the aperture to a spout outlet and a flexible outer member that has a sealing ridge that extends outwardly from an inner surface of the flexible outer member. The sealing ridge has an end surface that contacts an upper surface of the first inner member to substantially close the channel. The movable drinking spout is connected to the flexible outer member such that a movement of the movable spout deflects the flexible outer member and raises at least a portion of the end surface of the sealing ridge from the upper surface of the inner member to open the channel extending from the aperture to the spout outlet.

In any of the above aspects, in some applications, the valve assembly is in the form of a lid.

In another aspect, the invention features a container for delivering a liquid that includes a vessel having an open end and a first cavity for holding a liquid. A lid is connected to the vessel. The lid includes an inner member that has at least one aperture to provide fluid communication between the first cavity and an openable valve cavity that is formed by an upper surface of the inner member and an inner surface of a flexible outer member. Extending from the outer member is a movable spout that forms a third cavity. The inner surface of the flexible outer member contacts the upper surface of the inner member to block fluid communication between the valve cavity and the third cavity with the spout in a first position. The inner and upper surface separate, at least partially, from each other in response to a movement of the movable spout to a second position to allow fluid communication between the valve cavity and third cavity.

In any of the above aspects, in certain embodiments, the movable spout extends integrally from the outer member. In some cases, the inner member has a multiplicity of apertures.

Preferably, the valve assembly (or lid) of certain embodiments is configured to provide a flow rate through the spout outlet from about two mL/s to about 20 mL/s, and more preferably from about three mL/s to about 20 mL/s, or from about 15 mL/s to about 20 mL/s.

In some cases, the movable spout includes an outer casing having an outer opening at an end of the movable drinking spout that is connected to the outer member and an inner casing connected to the outer casing that has an inner opening having a dimension less than the outer opening and aligned with the outer opening of the outer casing. The outer wall can be configured to attach to a vessel. In certain applications, the inner casing is joined to an outer wall by a flexible web with the outer member also attached to the outer wall. In some cases, the inner casing forms multiple, separate openings at an end of the movable spout. In certain ones of these cases, the outer opening of the outer casing circumscribes all of the multiple openings of the inner casing.

The inner casing and the outer wall can be formed of the same material. In some of these cases, the outer member and the outer casing are formed of a material different than the material used to form the inner casing and the outer wall. In some embodiments, the inner casing is formed of a first material having a first hardness and the outer casing is formed of a second material having a second hardness that is different from the first hardness of the first material. The hardness of the second material can be less than the hardness of the first material.

In some embodiments, the inner member is dimensionally stable. In some embodiments, the inner member is removable from the valve assembly (or lid). The inner member and/or the outer member may have a concave portion. In some cases, the inner member includes a sidewall and the concave portion extends from the sidewall. In certain ones of these cases, the inner member is substantially circular and includes a flange extending outwardly from the sidewall and circumferentially about the inner member.

In certain embodiments, the spout is oval in cross-section. In other cases, the spout is dimensionally axisymmetric. This can provide a spout capable of enabling flow in response to multiple lateral movements of the spout in different directions. The spout can include multiple, separate openings forming the spout outlet at the end of the movable spout. In some embodiments, prior to moving the spout, e.g., while in the first position, the spout extends along an angle relative to a horizontal of between about 90 degrees to about 45 degrees, such as about 83 degrees. Preferably, to enable fluid flow through the spout outlet, the spout is moved from about one degree to about 45 degrees, and more preferably about three degrees.

In some embodiments, the inner member is formed of a flexible material. In some of these cases, a movement of the movable spout deforms the inner member causing a mismatch between the inner surface of the outer member and inner member to enable fluid flow through the channel and/or spout outlet.

In some of cases, the lid (or valve assembly) may be connected to a vessel that has a capacity of, e.g., between about three ounces to about 15 ounces, or between about six ounces to about 32 ounces. For some cases, the lid includes a threaded inner surface that is configured to mate with a threaded outer surface of the vessel. This can allow the lid to be removed from the vessel and, in some embodiments, allow removal of a removable inner member.

In another aspect, the invention features a lid for use with a drinking container. The lid includes a flexible outer member lined, a limited extent, by a harder inner casing. The inner casing and outer member form a movable drinking spout extending from an upper surface of the lid.

In certain applications, the inner casing is joined to an outer wall by a web. The outer wall can include an inner surface capable of engaging a vessel to connect the lid to the vessel.

Aspects may have one or more of the following advantages. A valve assembly can be provided that is relatively easy to open and close and comfortable in use. Relatively little movement of the spout may be required, in some embodiments, to open the channel to allow flow through the channel toward the spout outlet. In some embodiments, only a modest movement of the spout is necessary to provide relatively high flow rates through the spout outlet. In some cases, the inner member may be removed from the valve assembly, e.g., for cleaning. In some of these cases, the removable inner member may be replaced by a different inner member that provides a different flow rate. This allows a user to modify the valve assembly based on, e.g., a particular user's needs and/or requirements.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
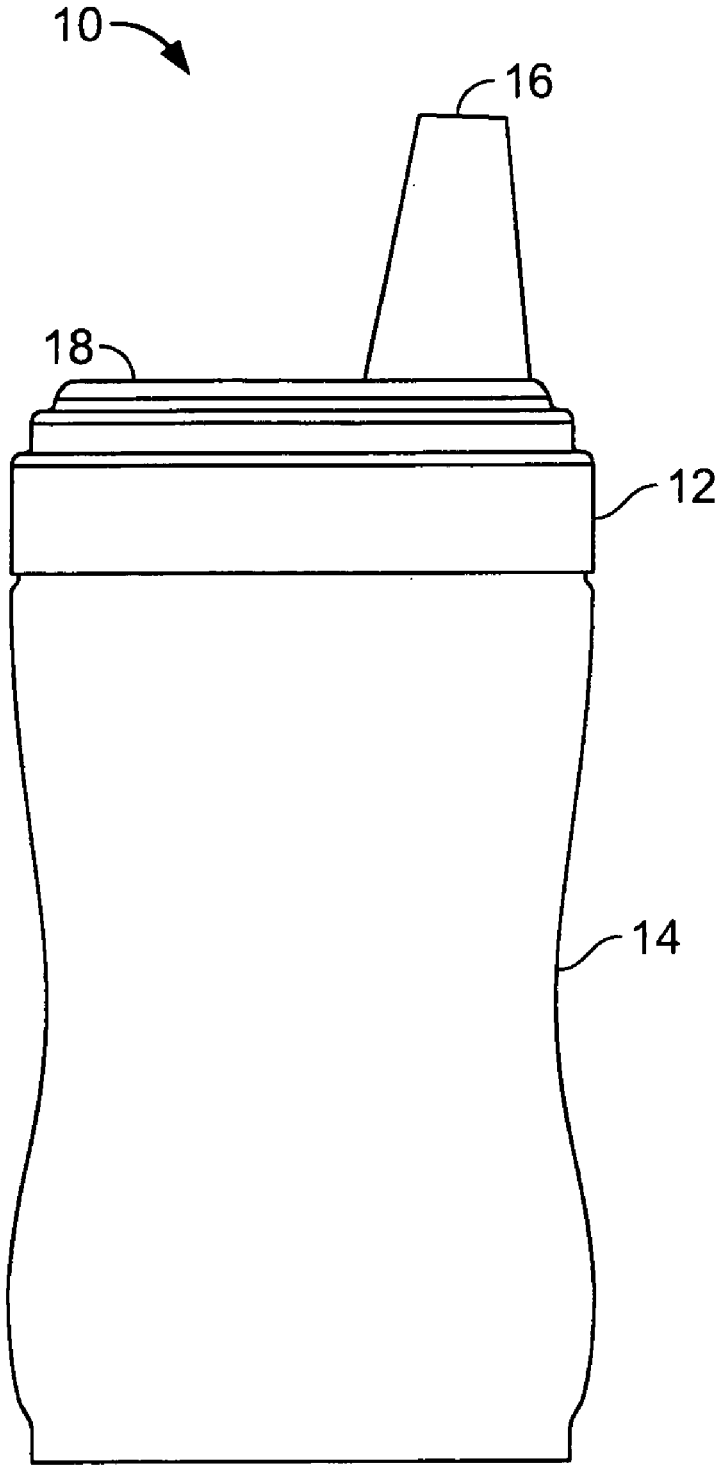
FIG. 1A is a side view of an embodiment of a drinking container including a valve assembly.
Figure 1B:
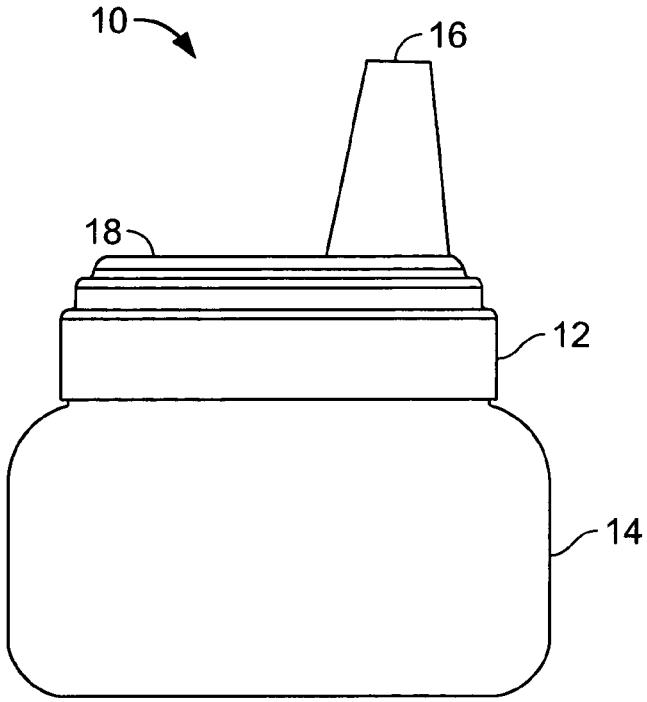
FIG. 1B is a side view of another embodiment of a drinking container including valve assembly.

Referring to FIGS. 1A and 1B, a drinking container 10 includes a lid 12 and a vessel 14 suitable for holding a liquid. Lid 12 has a movable spout 16 formed of a resilient material that, upon application of a force, can be elastically deflected which, in turn, can elastically deflect a flexible outer member 18 to open a channel from a valve cavity to an opening at an end of movable spout 16. By opening the channel, fluid can pass through the movable spout and out the opening, the details of which will be described in greater detail below. Upon removal of the force from the movable spout 16, the spout 16 and flexible outer member 18 return, at least substantially, to their original positions to close or at least partially close the channel of the valve cavity.

Figure 2:
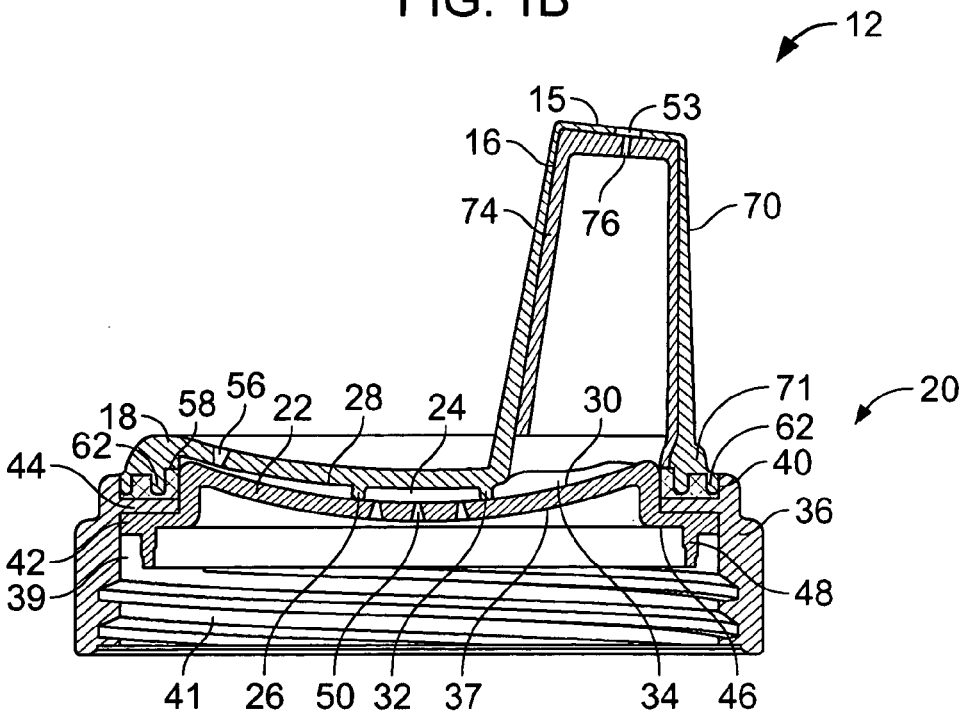
FIG. 2 is a cross-sectional side view of the valve assembly of FIG. 1 in a closed position.
Figure 3:
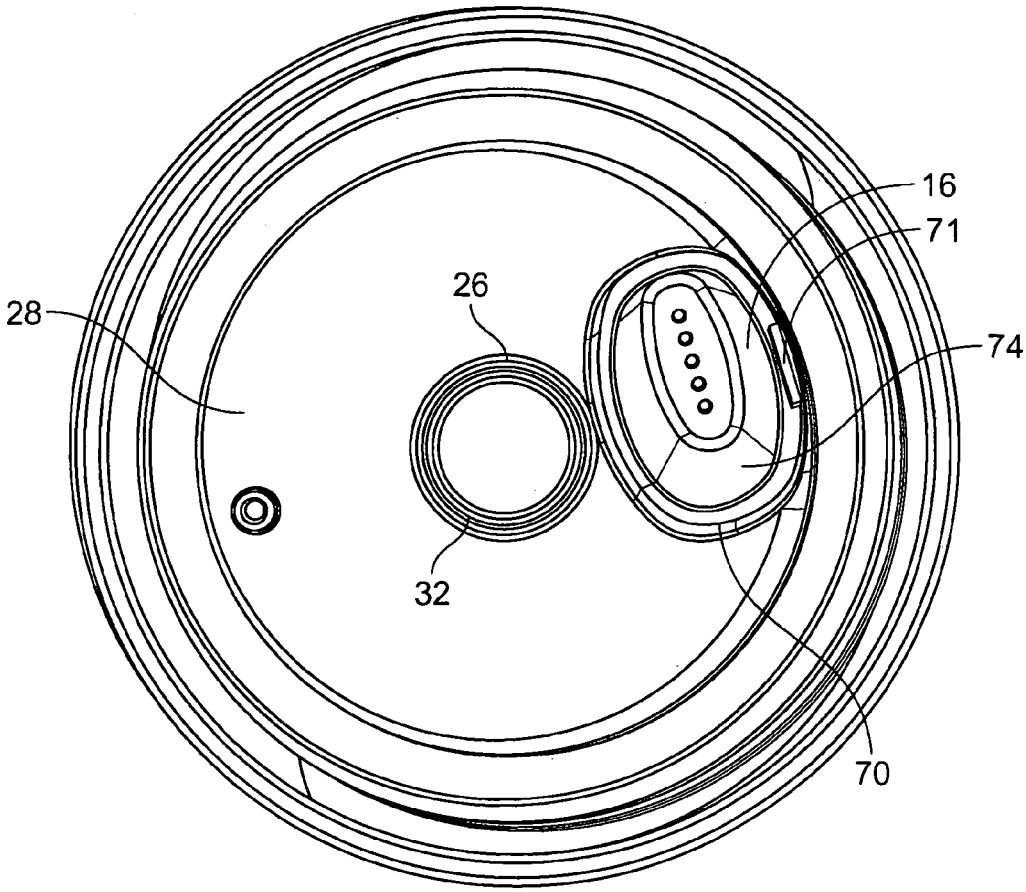
FIG. 3 is a bottom view of a flexible outer member and movable spout of the valve assembly of FIG. 1.

FIG. 2 shows a drinking valve assembly 20 in the form of lid 12 for controlling liquid flow. Drinking valve assembly 20 includes an inner member 22 connected to flexible outer member 18 with an openable valve cavity 24 formed therebetween. In one embodiment, the valve cavity 24 is formed by a substantially circular sealing ridge 26 that extends from a lower surface 28 of the flexible outer member 18 when sealing ridge 26 is in contact with an outer surface 30 of inner member 22. In one embodiment, movable spout 16 can extend integrally from flexible outer member 18 such that a force applied to the movable spout 16, sufficient to move the movable spout 16, can deflect the flexible outer member 18 and raise at least a portion of an end surface 32 (see also FIG. 3) of sealing ridge 26 from outer surface 30 of inner member 22 to open the valve cavity 24 to the channel 34 extending from valve cavity 24 to an end 15 of movable spout 16. In some embodiments, a movement of movable spout 16 can raise all of end surface 32 from outer surface 30 to open channel 34.

Figure 6:
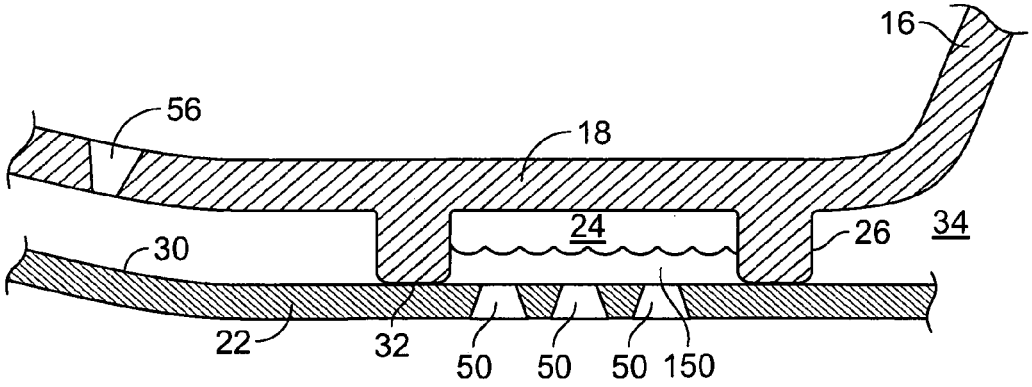
FIG. 6 is a cross-sectional detail view of the valve assembly of FIG. 1 in a closed position.

FIGS. 2 and 6 illustrate valve assembly 20 in a closed position with movable spout 16 unloaded. Shown most clearly by FIG. 6, depicting the valve assembly 20 in the closed position, end surface 32 is in contact with outer surface 30 of inner member 22. Although fluid 150 can enter valve cavity 24, sealing ridge 26 substantially prevents flow of fluid from the valve cavity 24, through channel 34 and toward end 15 of movable spout 16 (FIG. 2).

Figure 7:
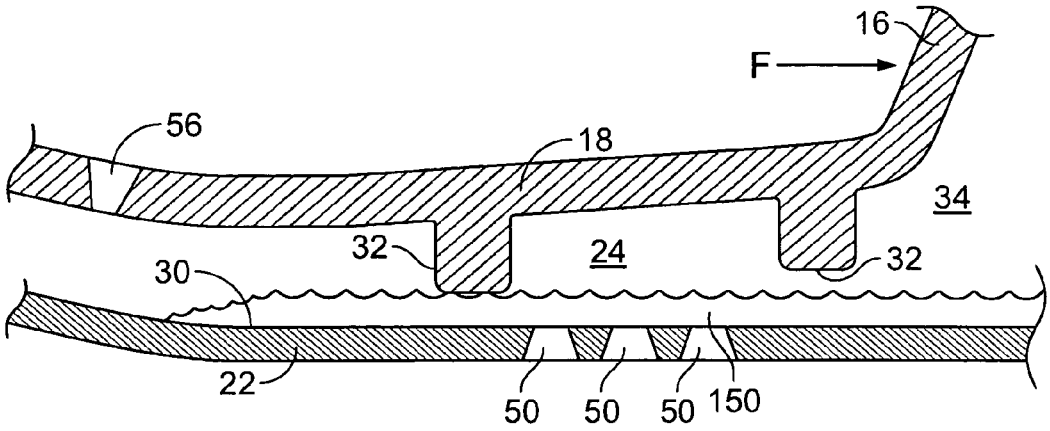
FIG. 7 is a cross-sectional detail view of the valve assembly of FIG. 1 in an open position.
Figure 8A:
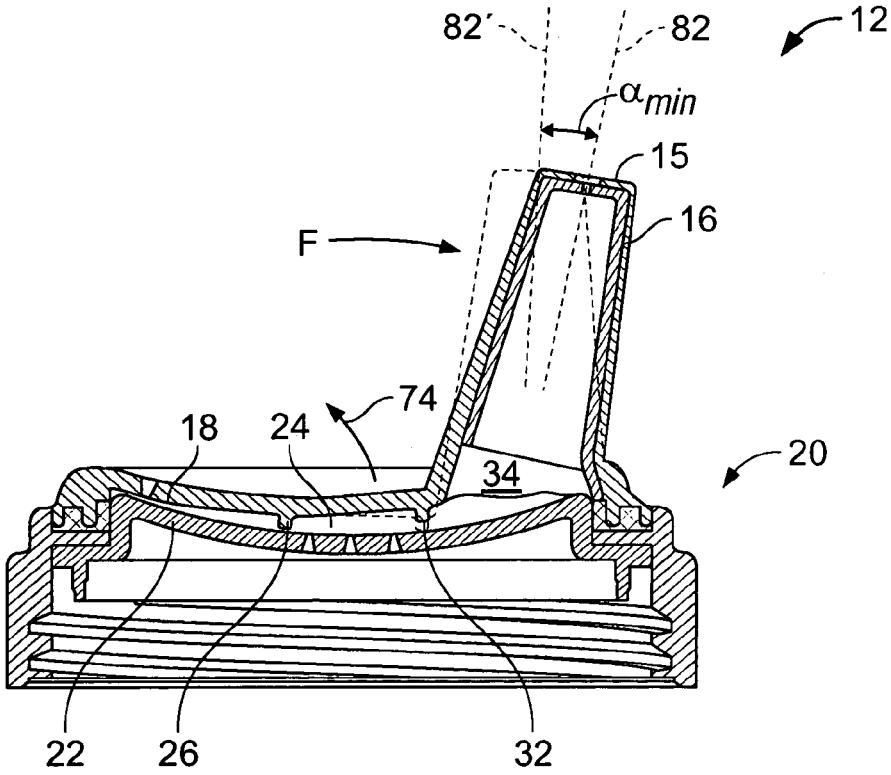
FIG. 8A is a cross-sectional side view of the valve assembly of FIG. 1 in an open position.

FIGS. 7 and 8A illustrate valve assembly 20 in an open position with movable spout 16 loaded by application of a force F sufficient to move the movable spout 16 and deflect flexible outer member 26 to raise end surface 32 away from contact with outer surface 30 of inner member 22. Shown most clearly by FIG. 7, when the valve assembly 20 is in the open position, fluid can flow from valve cavity 24 and through channel 34 toward end 15 of movable spout 16. When the force F is removed from the movable spout 16, end surface 32 engages the outer surface of the inner member 22 to block the flow of fluid through the channel 34.

Figure 11A:
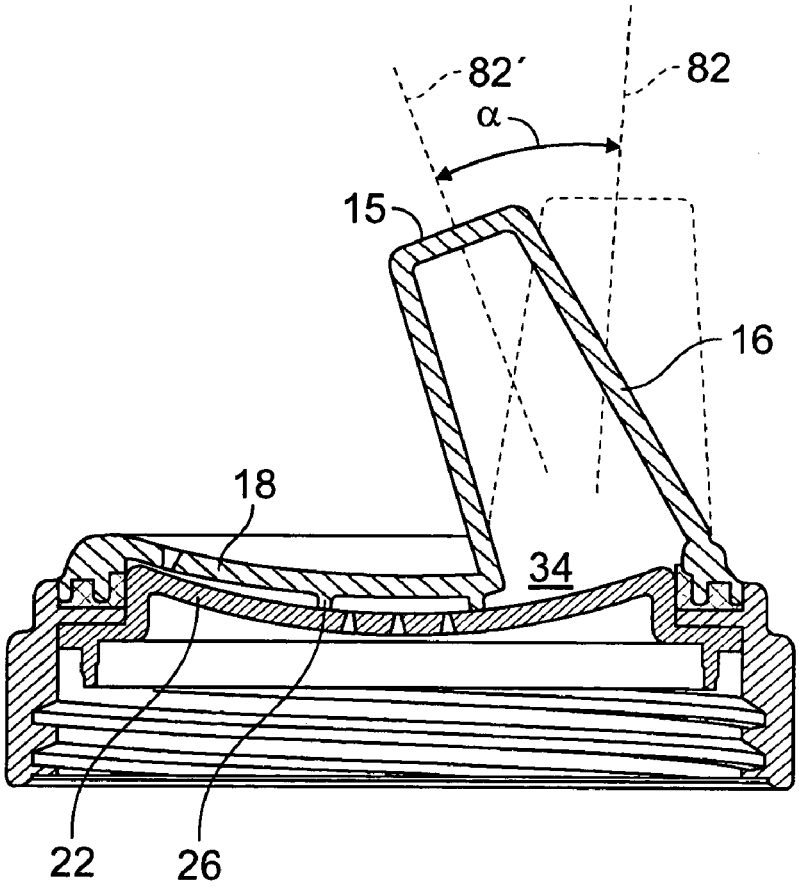
FIG. 11A is a cross-sectional side view of another embodiment of a valve assembly.
Figure 11B:
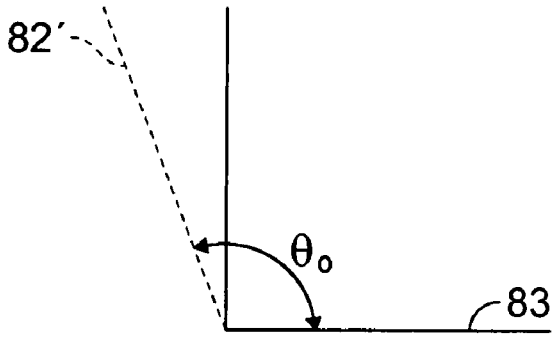
FIG. 11B illustrates an angle of a movable spout of the valve assembly of FIG. 11A.

With renewed reference to FIG. 2, lid 12 includes an outer wall 36 having a threaded inner surface 41 for connecting lid 12 to vessel 14. Any suitable vessel can be employed (e.g., glass bottles, plastic bottles, baby bottles, sport drink containers, etc.). In some embodiments, vessel 14 has a capacity greater than about three ounces, such as from about three ounces to about 15 oz (e.g., for a small child, see FIG. 11B, for example). In some embodiments, vessel 14 has a capacity greater than about six ounces, such as from about six ounces to about 32 oz (e.g., for an adult). Vessel 14 has a corresponding threaded outer surface (not shown) to form a fluid-tight seal between lid 12 and the vessel 14. Other connections between lid 12 and vessel 14 are envisioned such as beaded connections, snaps, detents, and the like. In some cases, a seal (e.g., O-rings, gaskets, etc.) can also be used along with any suitable connection to form to fluid-tight seal between lid 12 and vessel 14.

Figure 5A:
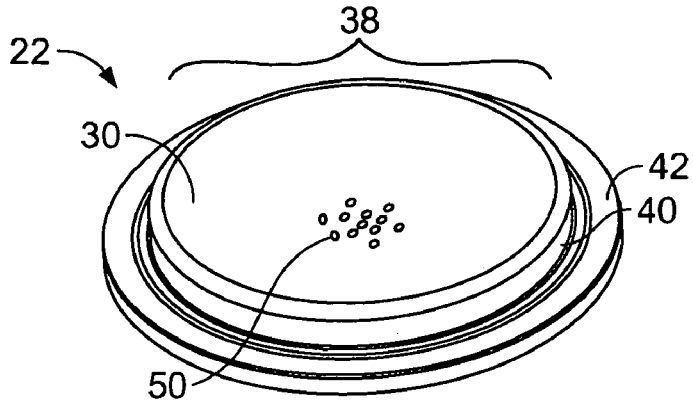
FIGS. 5A–5C illustrates various inner member embodiments of the valve assembly of FIG. 1.

Seated within outer wall 36 is the inner member 22. Referring to FIG. 5A, as an example, inner member 22 includes a concave portion 38 extending laterally from a sidewall 40. In alternative embodiments, portion 38 can be convex, relatively flat, etc. A circumferential flange 42 projects outwardly from a lower portion of sidewall 40.

As shown by FIG. 2, flange 42 seats against a stop 44 extending inwardly from an inner surface 39 of outer wall 36. Inner member 22 is dimensioned to fit removably within outer wall 36. In some cases, inner member 22 fits snuggly within outer wall 36 (e.g., an outer diameter of the inner member closely approximates an inner diameter of the outer wall). In some embodiments, inner member 22 is formed of a relatively rigid, dimensionally stable material. In other embodiments, inner member 22 is formed of a flexible and/or compressible material. In these cases, the outer diameter of inner member 22 can be greater than the inner diameter of outer wall 36 and the inner member 22 can be compressed or flexed to position the inner member 22 within the outer wall 36 and seated against stop 44. A lip 48 extends from a lower surface 46 of flange 42. Lip 48 along with lower surface 46 and inner surface 39 form a U-shaped recess that can receive a ledge (not shown) of vessel 14 forming a fluid-tight seal when the vessel is connected to lid 12. Inner member 22 may also be formed without lip 48. In some embodiments, the ledge of vessel 14 contacts lower surface 46 of flange 42. In these cases, the ledge of vessel 14 can serve to secure inner member 22 against stop 44.

Within concave portion 38, inner member 22 has an aperture 50 that provides a passageway for fluid contained within vessel 14. Any suitable aperture shape (e.g., circular, square, etc.), number (e.g., from 1 to 40, or greater, such as 12) and/or configuration of apertures can be employed that provide a desired flow rate through opening 53 at end 15 of movable spout 16. For example, referring to FIG. 5A, inner member 22 is shown having 13 relatively small apertures 50 arranged near a center of concave portion 38. In another embodiment, inner member 112 has two relatively mid-sized apertures 50 arranged near the center of concave portion 38. In yet another embodiment, inner member 122 has a non-circular, aperture 50.

Generally, the size and shape of aperture 50 can be formed as desired. In some embodiments, aperture 50 is circular having a diameter of about 0.006 inch to about 0.5 inch (e.g., from about 0.01 inch to about 0.02 inch, from about 0.021 inch to about 0.03 inch, from about 0.031 inch to about 0.04 inch). In some cases, such as that illustrated by FIG. 2, aperture 50 tapers from a maximum diameter located at an inner surface 37 of inner member 22 to a minimum diameter located at an outer surface 30 of inner member 22. The maximum diameter for a tapered aperture can also be located at outer surface 30 of inner member 22.

Referring back to FIG. 2, contacting outer surface 30 of inner member 22 is end surface 32 of sealing ridge 26 that extends outwardly from lower surface 28 of flexible outer member 18 to form openable valve cavity 24. As can also be seen from FIG. 3, sealing ridge 26 is circular and has an inner diameter sized to extend about apertures 50 when the inner member 22 is fitted into the outer member 26. Sealing ridge 26, when in contact with outer surface 30 of inner member 22, forms a seal to substantially prevent passage of fluid from valve cavity 24 along channel 34 formed between the inner and flexible outer members 22, 26 to end 15 of movable spout 16. In some embodiments, sealing ridge 26, when in contact with outer surface 30 of inner member 22, provides a fluid-tight seal preventing passage of fluid from valve cavity 24.

Figure 4:
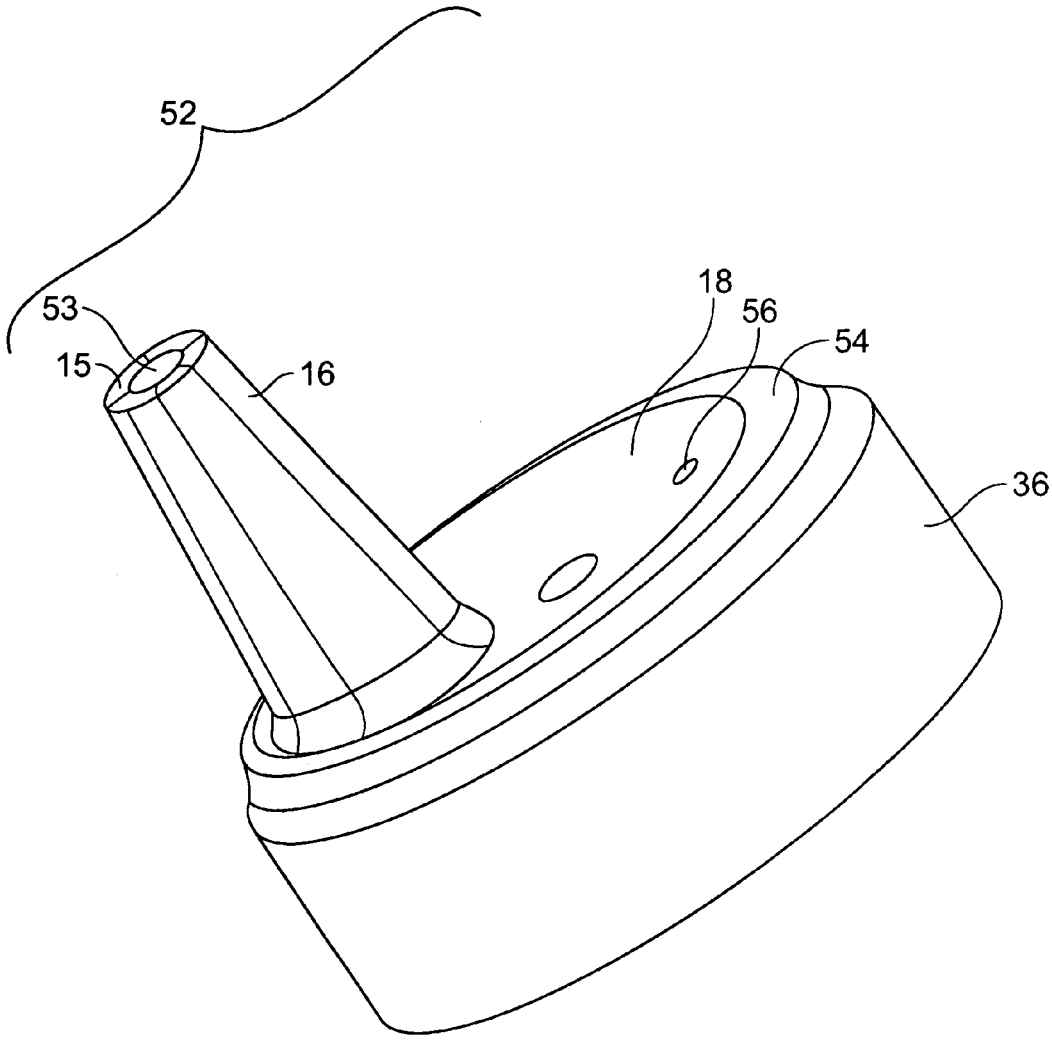
FIG. 4 is a perspective view of the valve assembly of FIG. 1.
Figure 5B:
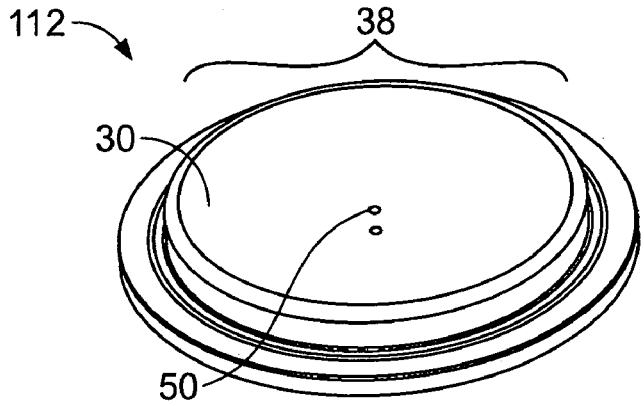
Figure 5C:
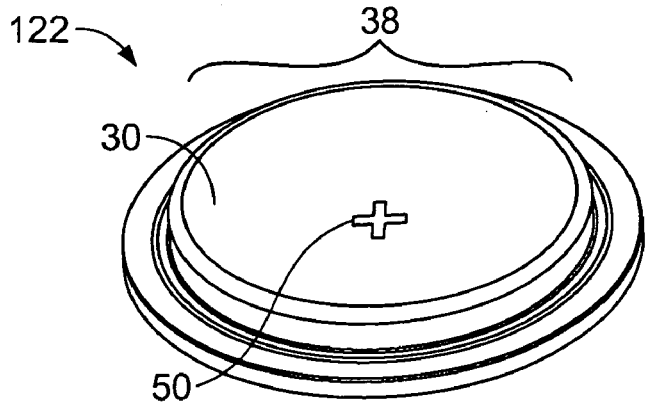

Referring also to FIG. 4, flexible outer member 18 has a concave portion 52 that extends from a sidewall 54. Concave portion 52 is shaped to facilitate removal of end surface 32 from outer surface 30 upon deflection of movable spout 16. Concave portions 38 (see FIGS. 5A–5C) and 52 cooperate to provide a relatively faster response (i.e., relatively little deflection of spout 16 is needed to raise end surface 32 from outer surface 30) to movement of spout 16. A fast response is particularly desirable for small children. Concave portions 38 and 52 also enable greater separation between end surface 32 and outer surface 30 which, in turn, allows for greater rates of fluid flow through channel 34. Flexible outer member 18 also includes a vent 56 that allows air to enter into valve cavity 24 when the valve cavity 24 is open (see also FIG. 7) to facilitate fluid flow through the channel 34.

Referring back to FIG. 2, flexible outer member 18 is secured to outer wall 36 by a fitting 58 positioned within a recess 60 formed between outer wall 36 and sidewall 40 of inner member 22. Fitting 58 includes a pair of grooves extending inwardly from an upper surface of the fitting that snugly receive a pair of beads 62 extending outwardly from a lower surface of flexible outer member 18 forming a snap-type mechanical connection. Beads 62 can be bonded within the grooves, by for example, adhesives, welding and the like. In some cases, frictional contact between beads 62 and fitting 58 secures the beads within the grooves.

Fitting 58 can be bonded to outer wall 36 by, for example, adhesives, ultrasonic welding and the like. In some cases, fitting 58 is secured within recess 60 by frictional contact between fitting 58, sidewall 40 and outer wall 36.

As an alternative to using fitting 58, in some embodiments, flexible outer member 18 is secured directly to outer wall 36. For example, outer wall 36 can include grooves sized to receive beads 62. In some cases, adhesives, ultrasonic welding, etc. may be used to bond flexible outer member 18 to outer wall 36.

As shown, within concave portion 52, flexible outer member 18 is integral with an outer casing 70 of movable spout 16. Outer casing 70 of movable spout 16 includes opening 53 located at end 15 of the movable spout. An inner casing 74 extends from outer wall 36 and is attached to outer casing 70. Inner casing 74 is connected to outer wall 36 by a web 71 that restricts some movements of the inner casing 74 while allowing other movements of the inner casing 74 (see also FIG. 3). Inner casing 74 includes an opening 76 that is aligned with opening 53 of the outer casing. Opening 76 of inner casing 74 is smaller than the opening 53 that opening 76 coincides with to restrict flow of fluid through end 15 of movable spout 16. In some embodiments, inner casing 74 includes multiple openings 76. In certain embodiments, outer opening 52 of outer casing 70 is sized to circumscribe multiple openings 76 (such as five openings) of inner casing 74.

As illustrated, inner and outer casings 74, 70 are formed of different materials. Inner casing provides reinforcing support and resiliency for spout 16 (e.g., to minimize deformation of the spout and/or to prevent or minimize collapse of the spout when squeezed and/or bitten). In some embodiments, inner and outer casings 74, 70 are formed of the same material. In some embodiments, movable spout 16 is formed of only one casing that extends from flexible outer member 18. In some cases, outer casing 70 includes an opening at end 15 having different inner diameters to form a flow restriction.

Inner member 22 is removable from lid 12 (e.g., for cleaning). In some cases, inner member 22 can be replaced with a different inner member 22, e.g., having a different number and/or configuration of apertures 50, for example, by an inner member (such as any of those shown by FIGS. 5B–5C) that provides a different flow rate through end 15 of spout 16 than that provided by inner member 22 (see FIG. 5A) at a particular drinking condition. By providing interchangeable inner members 22, a user can selectively choose an inner member that provides a desirable flow rate.

Flexible outer member 18 and outer casing 70 are formed of a flexible, resilient material (e.g., thermoplastic elastomers (TPE)) that enable the spout and flexible outer member to at least substantially return to their original, undeflected positions with the sealing ridge substantially closing channel 34. A suitable material for inner casing is, e.g, polypropylene (PP). Any suitable material (e.g., PP, polycarbonate (PC), acrylonitrile-butadiene-styrene (ABS), polystyrene (PS), TPE) can be used to form inner member 22. Suitable materials for outer wall 36 include, for example, PC, PP, ABS, PS and TPE.

Any suitable manufacturing technique can be used to form flexible outer member 18, outer wall 36, inner member 22, movable spout 15, etc. such as molding including injection molding, compression molding, injection blow molding, as examples. In some embodiments, flexible outer member 18 and outer casing 70 are over molded onto inner casing 74 and outer wall 36.

Generally, valve assembly 10 can be designed to provide a desirable flow rate and/or range of flow rates through end 15 of movable spout 16. A suitable test for determining flow rate through end 15 of spout 16 under a predetermined drinking condition includes using a vacuum pump flow rate test ("Flow Test") where a vacuum pump is utilized to provide a continuous suction at a relatively constant pressure. The Flow Test method includes filling a drinking container 10 having a valve assembly 12 attached thereto with the drinking container 10 being filled with an amount of water. The drinking container 10 is then weighed on a scale set to grams. A vacuum pump is provided and the movable spout 16 of the valve assembly 12 is inserted into an adapter attached to the vacuum pump. The drinking container 10 is held at an inverted angle of at least 45 degrees to ensure that water is positioned adjacent the aperture 50 of the inner member 22 throughout the testing cycle. The channel 34 is opened, the vacuum pump is activated and a suction pressure of eight in-Hg is maintained for a period of 10 seconds. The drinking container 10 is then weighed to determine the weight (in grams) of water removed. The suctioning and weighing steps are repeated two additional times for a total of three cycles. Additional amounts of water can be added, if required. The three cycles are averaged to determine the average weight loss. To calculate the flow rate per second, the average weight of water loss (in grams) is divided by the number of seconds suction pressure is maintained during each cycle (10 seconds).

Using the Flow Test method, a preferable flow rate through end 15 of spout 16 is from about two mL/s to about 20 mL/s. As described further below, a desirable flow rate can depend, at least in part, on the age of the user. For a small child, a preferable flow rate is from about three mL/s to about 10 mL/s, such as about eight mL/s. For an adult, a preferable flow rate is from about 15 mL/s to about 20 mL/s, such as about 18 mL/s. A preferable intermediate flow rate range is from about eight mL/s to about 16 mL/s.

Referring now to FIG. 8A, lid 12 is shown with valve assembly 20 in the open position, as indicated by the solid lines. The dotted lines of FIG. 8 show valve assembly 20 in the closed, e.g., unloaded position.

Passing through a center of movable spout 16 is a central axis 82 (82' in the closed position). Referring also to FIG. 8C, in the closed, e.g., unloaded position, axis 82' intersects the horizontal (represented by line 83 of FIG. 8B) at angle $\theta_0$ (e.g., from about 90 degrees to about 45 degrees, such as about 83 degrees). As movable spout 16 is moved away from its initial, unloaded position, forming an angle $\alpha$ between 82' and 82, the flexible outer member 18 deflects in the direction of arrow 79. Movable spout 16 can continue to be moved until a increases to a minimum angle $\alpha_{min}$ (e.g., from about 1 degree to about 45 degrees, such as about 3 degrees) where end surface 32 of sealing ridge 26 is raised from outer surface 30 of inner member 22, corresponding to the opening of channel 34. In some cases, moving movable spout 16 through angle $\alpha_{min}$ raises only a portion of end surface 32 from inner member 22. In other cases, moving movable spout $\alpha_{min}$ raises all of end surface 32 from inner member 22.

While FIG. 8A shows a lateral deflection of movable spout 16, other movements of spout 16 may displace end surface 32, raising the end surface from inner member 22 to open channel 34. For example, in some embodiments, channel 34 is opened by an outward vertical movement (in a direction perpendicular to horizontal 83) of spout 16. Other lateral movements of spout 16 may also open channel 34. In some embodiments, movable spout 16 can be compressed (e.g., with the mouth) to open channel 34. In certain ones of these embodiments, the spout 16 is formed of only an outer casing that is formed of a relatively flexible (e.g., durometer of about 50 Shore A to about 100 Shore A) material (e.g., TPE). In some embodiments, certain movements of movable spout 16 do not open channel 34.

Figure 8B:
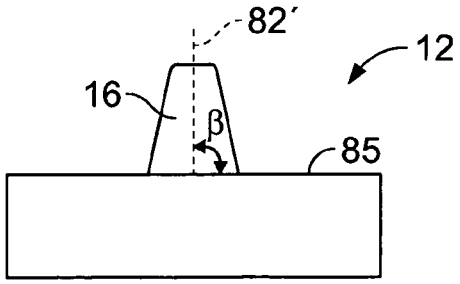
FIG. 8B is a somewhat diagrammatical front view of the valve assembly of FIG. 8A.
Figure 8C:
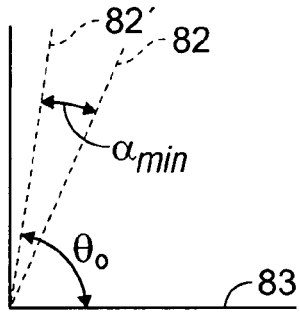
FIG. 8C illustrates various angles of a movable spout of the valve assembly embodiment of FIG. 8.

As can be seen in FIG. 8B, in a front view, axis 82' forms an angle β with a horizontal 85. Generally, β can be selected as desired. Preferably, angle β is about 90 degrees. In some embodiments, upon deflection of movable spout 16, angle β may change. In some cases, upon deflection of movable drinking spout 16, angle β remains substantially constant.

In some embodiments, α can be increased from $\alpha_{min}$ to $\alpha_{max}$ (not shown). In some cases, as a is increased beyond $\alpha_{min}$, a flow rate through channel 34 is also increased due to continued deflection of flexible outer member 18 that raises end surface 32 an increased distance from inner member 22. This allows for variable flow rate control through end 52 of movable spout 16 corresponding to the amount of deflection of the spout 16 in a direction away from its initial, unloaded position. As noted above, the flow rate through end 15 of spout 16 can be further limited by the size of opening 76, where present. In some embodiments, $\alpha_{max}$ (corresponding to the maximum deflection of movable spout away from its initial, unloaded position) is about 45 degrees or less (e.g., 30 degrees, 20 degrees, 10 degrees, three degrees, one degree, from about one degree to about 45 degrees).

Figure 9A:
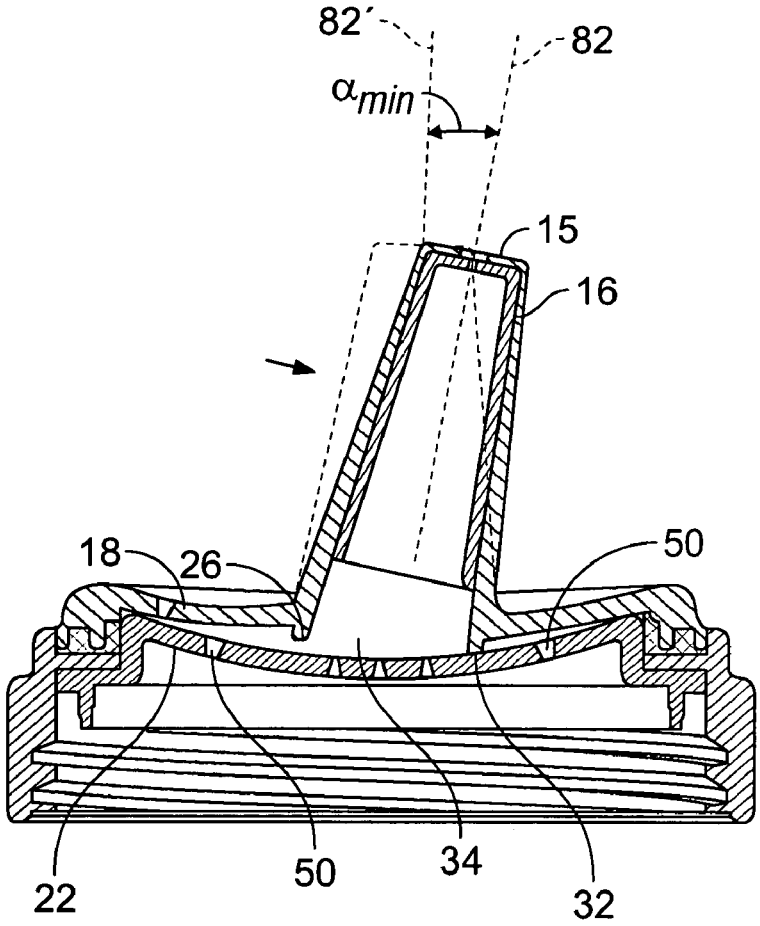
FIG. 9A is a cross-sectional side view of another embodiment of a valve assembly.
Figure 9B:
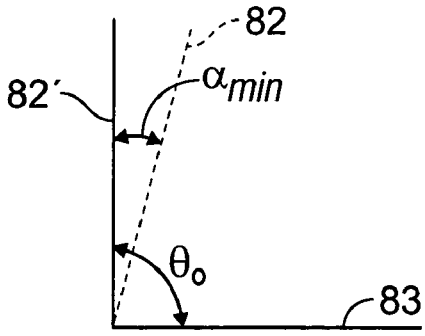
FIG. 9B illustrates various angles of a movable spout of the valve assembly of FIG. 9A.
Figure 10:
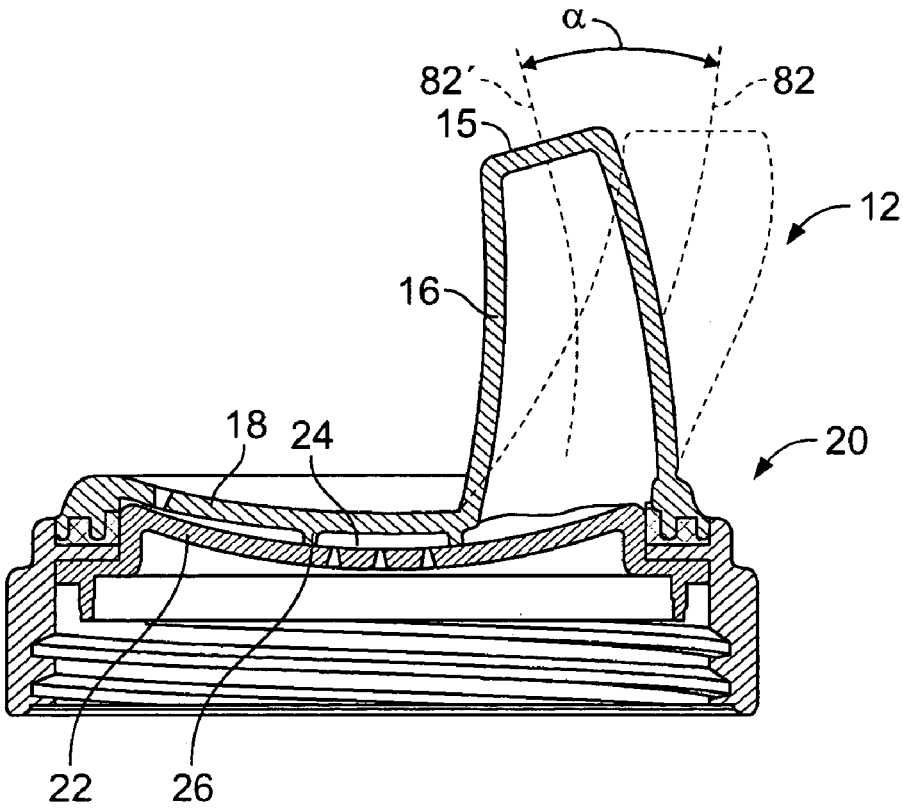
FIG. 10 is a cross-sectional view of another embodiment of a valve assembly.

Other movable spout configurations are contemplated. In some cases, axis 82' of movable spout 16 is perpendicular to the horizontal 83. For example, as illustrated by FIG. 9A, movable spout 16 extends centrally from flexible member 18 and has axis 82' that is substantially perpendicular to horizontal 83 (see FIG. 9A). Movable spout 16, as shown, is substantially axisymmetric (e.g., substantially circular in cross section). Sealing ridge 26 extends about spout 16 between end 15 and aperture 50 to close channel 34 extending from aperture 50 to the end of the movable spout. As above, a movement of movable spout 16 away from its initial, unloaded position deflects axis 82' an angle α until $\alpha_{min}$ is reached corresponding to the opening of channel 34. As shown, movable spout 16 can be moved laterally in multiple, differing directions, to enable flow along the channel 34. In some cases, a vertical movement can open channel 34. Referring to FIG. 10, in certain cases, movable spout 16 has a curved and/or an irregular shape. Axis 82', like above, extends through the center of movable spout 16 and a movement of the movable spout away from its initial position deflects axis 82' an angle α from an initial, undeflected position. In some embodiments, $\theta_0$ of axis 82' is greater than 90 degrees (see FIGS. 11A and 11B). An advantage of this configuration is that the position (or shape) of movable spout 16 can further encourage a user (e.g., a small child) to move the movable spout to open channel 34. The relation between movable spout 16 and flexible outer member 18 necessitates deflection by a user to drink comfortably from the spout 16. Upon movement of spout 16 away from its initial, undeflected position, channel 34 is opened and the orientation of the movable spout in relation to flexible outer member 18 is adjusted such that the user can drink more comfortably.

Figure 12:
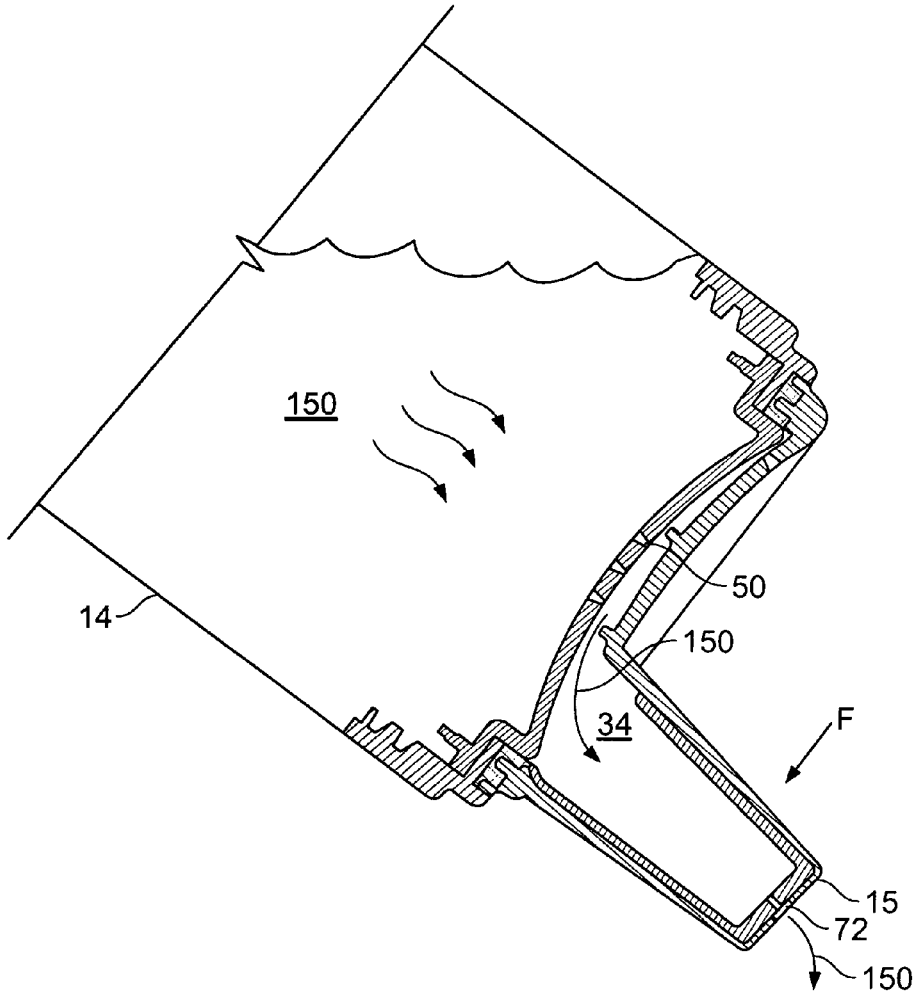
FIG. 12 is a cross-sectional side view of an embodiment of a drinking container with valve assembly of FIG. 1.

In use, referring now to FIG. 12, a force is applied (e.g., by hand, mouth, etc.) in the direction of arrow F, as an example, opening valve cavity 24. In some embodiments, a force of about one to about five Newtons is sufficient to open valve cavity. Fluid 150 passes from vessel 14, through aperture 50 and into channel 34 where fluid 150 is free to pass through opening 72 located at end 15 of the movable spout.

A number of embodiments of the invention have been described. Nevertheless, it will be understood that various modifications may be made without departing from the spirit and scope of the invention. For example, the sealing ridge can be a solid plug having an end surface that can cover the aperture of the inner member to close the channel. The outer surface of the inner can be recessed to receive the end surface of the sealing ridge. In some embodiments, inner member 22 is formed of a relatively flexible, resilient material that can, itself, deflect upon a movement of movable spout 16, the deflection causing a mismatch between end surface 32 of sealing ridge 26 and upper surface 30 of the inner member to open valve cavity 34 (not shown). Accordingly, other embodiments are within the scope of the following claims.

What is claimed is:

1. A drinking valve assembly comprising:

an inner member defining an aperture; and an outer member including a movable drinking spout extending from an upper surface of the outer member, the inner member and the outer member defining a channel extending from the aperture to a spout outlet;

wherein the outer member has an inner surface that contacts the inner member about the aperture to block a flow along the channel with the spout in a first position, the inner surface of the outer member being displaced from the inner member in response to movement of the spout to a second position to enable flow along the channel.

2. The drinking valve assembly of claim 1, wherein the inner member is dimensionally stable.

3. The drinking valve assembly of claim 1 further comprising an outer wall configured to receive the inner member and position the inner member adjacent the outer member such that the inner surface of the outer member contacts the inner member with the spout in the first position to block flow along the channel.

4. The drinking valve assembly of claim 1, wherein the outer member is constructed to resiliently deform as the movable drinking spout is moved from the first position to the second position.

5. The drinking valve assembly of claim 4, wherein the outer member flexes relative to the upper surface of the outer member from the first position to the second position.

6. The drinking valve assembly of claim 1 in the form of a lid.

7. The drinking valve assembly of claim 6, wherein the lid is connected to a vessel.

8. The drinking valve assembly of claim 7, wherein the lid includes a threaded inner surface configured to mate with a threaded outer surface of the vessel.

9. The drinking valve assembly of claim 1, wherein the movable drinking spout moves a distance from at least about one degree to about 45 degrees from the first position to the second position to enable flow along the channel.

10. The drinking valve assembly of claim 9, wherein the movable spout moves a distance of about 3 degrees from the first position to the second position to enable flow along the channel.

11. The drinking valve assembly of claim 1, wherein the movable drinking spout extends integrally from the outer member.

12. The drinking valve assembly of claim 1, wherein the inner member defines a multiplicity of apertures.

13. The drinking valve assembly of claim 1 configured to provide a flow rate through the spout outlet from about 2 mL/s to about 20 mL/s.

14. The drinking valve assembly of claim 13 configured to provide a flow rate through the spout outlet from about 3 mL/s to about 10 mL/s.

15. The drinking valve assembly of claim 13 configured to provide a flow rate through the spout outlet from about 15 mL/s to about 20 mL/s.

16. The drinking valve assembly of claim 1, wherein the movable drinking spout comprises:

an outer casing having an outer opening at an end of the movable drinking spout, the outer casing connected to the outer member; and an inner casing connected to the outer casing, the inner casing having an inner opening aligned with the outer opening of the outer casing, the inner opening having a dimension less than the dimension of the outer opening.

17. The drinking valve assembly of claim 16, wherein the inner casing is joined to an outer wall by a flexible web, the outer member being attached to the outer wall.

18. The drinking valve assembly of claim 17, wherein the inner member includes a flange configured to seat against a stop extending inwardly from the outer outer wall, the stop positioned along the outer wall such that the inner member, when seated against the stop, contacts the inner surface of the outer member with the spout in the first position to block flow along the channel.

19. The drinking valve assembly of claim 17, wherein the inner casing and outer wall are formed of the same material.

20. The drinking valve assembly of claim 19, wherein the outer member and outer casing are formed of a material different than the material used to form the inner casing and outer wall.

21. The drinking valve assembly of claim 17, wherein the outer wall is configured to attach to a vessel.

22. The drinking valve assembly of claim 16, wherein the inner casing comprises a first material having a first hardness and the outer casing comprises a second material having a second hardness that is different from the first hardness of the first material.

23. The drinking valve assembly of claim 22, wherein the second material has a hardness less than the first hardness of the first material.

24. The drinking valve assembly of claim 16, wherein the inner casing defines multiple, separate openings at an end of the movable spout.

25. The drinking valve assembly of claim 24, wherein the outer opening of the outer casing circumscribes all of the multiple openings of the inner casing.

26. The drinking valve assembly of claim 1, wherein the inner member is removable from the valve assembly.

27. The drinking valve assembly of claim 1, wherein the inner member includes a sidewall and a concave portion extending from the sidewall.

28. The drinking valve assembly of claim 27, wherein the inner member is substantially circular and includes a flange extending outwardly from the sidewall and circumferentially about the inner member.

29. The drinking valve assembly of claim 1, wherein the outer member has a concave portion.

30. The drinking valve assembly of claim 1, wherein the outer member defines a vent spaced-apart from the movable spout to enable air to pass therethrough and into the channel with the spout in the second position.

31. The drinking valve assembly of claim 1, wherein the movable spout defines multiple, separate openings forming the spout outlet at an end of the movable spout.

32. The drinking assembly of claim 1, wherein the spout is oval in cross-section.

33. The drinking valve assembly of claim 1, wherein the spout, in the first postion, extends along an angle relative to a horizontal of between about 90 degrees to about 45 degrees.

34. The drinking valve assembly of claim 33, wherein the spout, in the first position, extends along an angle of about 83 degrees relative to the horizontal.

35. The drinking valve assembly of claim 1, wherein the inner surface that contacts the inner member is formed by a circular sealing ridge that extends outwardly from the inner surface of the outer member and is arranged to circumscribe the aperture of the inner member.

36. The drinking valve assembly of claim 1, wherein the inner member comprises a flexible material.

37. The drinking valve assembly of claim 1, wherein the movable spout is dimensionally axisymmetric.

38. The drinking valve assembly of claim 37, wherein multiple movements of the movable spout in more than one lateral direction are capable of enabling flow along the channel.

39. A drinking valve assembly comprising:

a first inner member defining an aperture to allow a fluid to pass therethrough;

a channel extending from the aperture to a spout outlet; and a flexible outer member having a sealing ridge extending outwardly from an inner surface of the flexible outer member, the sealing ridge having an end surface that contacts an upper surface of the first inner member to substantially close the channel;

a movable drinking spout connected to the flexible outer member such that a movement of the movable spout deflects the flexible outer member and raises at least a portion of the end surface of the sealing ridge from the upper surface of the first inner member to open the channel extending from the aperture to the spout outlet.

40. A drinking container for delivering a liquid, the drinking container comprising:

a vessel having an open end, the vessel defining a first cavity for holding a liquid; and a lid connected to the open end of the vessel, the lid comprising:

an inner member having at least one aperture to provide fluid communication between the first cavity and an openable valve cavity, the openable valve cavity defined by an upper surface of the inner member and an inner surface of a flexible outer member; and a movable spout extending from the outer member, the movable spout defining a third cavity;

wherein the inner surface of the flexible outer member contacts the upper surface of the inner member to block fluid communication between the valve cavity and the third cavity with the spout in a first position, the inner and upper surfaces at least partially separating from each other in response to movement of the movable spout to a second position to allow fluid communication between the valve cavity and third cavity.

41. The drinking container of claim 40, wherein the vessel and the lid include mating threaded surfaces.

42. The drinking container of claim 40, wherein the inner member is removable from the lid.

43. The drinking container of claim 40 configured to provide a flow rate through a spout outlet of between about 2 mL/s to about 20 mL/s.

44. The drinking container of claim 43 configured to provide a flow rate through a spout outlet of between about 3 mL/s to about 10 mL/s.

45. The drinking container of claim 43 configured to provide a flow rate through a spout outlet of between about 15 mL/s to about 20 mL/s.

46. The drinking container of claim 40, wherein the movable spout comprises:

an outer casing having an outer opening at an end of the movable spout, the outer casing connected to the flexible outer member; and an inner casing attached to the outer casing, the inner casing having an inner opening aligned with the outer opening of the outer casing, the inner opening having a dimension less than the dimension of the outer opening to reduce a flow rate of fluid passing through the outer opening.

47. The drinking container of claim 46, wherein the inner casing is joined to an outer wall by a flexible web, the outer member being attached to the outer wall.

48. The drinking container of claim 47, wherein the outer wall is configured to attach to a vessel.

49. The drinking container of claim 46, wherein the inner casing comprises a first material having a first hardness and the outer casing comprises a second material having a second hardness that is different from the first hardness of the first material.

50. The drinking container of claim 49, wherein the second material has a hardness less than the first hardness of the first material.

51. The drinking container of claim 46, wherein the inner casing and outer wall are formed of the same material.

52. The drinking container of claim 51, wherein the outer member and outer casing are formed of a material different than the material used to form the inner casing and outer wall.

53. The drinking container of claim 46, wherein the inner casing defines multiple, separate openings at an end of the movable spout.

54. The drinking container of claim 53, wherein the outer opening of the outer casing circumscribes all of the multiple openings of the inner casing.

55. The drinking container of claim 40, wherein the vessel is configured to contain from about 3 fluid ounces to about 15 fluid ounces.

56. The drinking container of claim 40, wherein the vessel is configured to contain from about 6 fluid ounces to about 42 fluid ounces.

57. The drinking container of claim 40, wherein the inner member comprises a flexible material.

58. The drinking container of claim 57, wherein movement of the movable spout deforms the inner member causing a mismatch between the inner surface of the outer member and inner member to enable flow along the channel.

59. The drinking container of claim 40, wherein the inner member comprises a dimensionally stable material.

60. The drinking container of claim 40, wherein the spout, in the first position, extends along an angle relative to a horizontal of between about 90 degrees to about −45 degrees.

61. The drinking container of claim 60, wherein the spout extends along an angle of about 83 degrees relative to the horizontal.

62. A drinking valve assembly comprising:

an inner member defining an aperture; and an outer member including a movable drinking spout extending from an upper surface of the outer member, the inner member and the outer member defining a channel extending from the aperture to a spout outlet;

wherein the outer member has an inner surface that contacts the inner member about the aperture to block a flow along the channel with the spout in a first position, the inner surface of outer member being displaced from the inner member in response to a flexing of the spout relative to the upper surface of the outer member to a second position to enable flow along the channel.

63. The drinking valve assembly of claim 62, wherein the movable drinking valve moves a distance from at least about 1 degree to about 45 degrees from the first position to the second position to enable flow along the channel.

64. The drinking valve assembly of claim 63, wherein the movable spout moves a distance of about 3 degrees from the first position to the second position to enable flow along the channel.

65. A method of adjusting flow rate of a drinking container valve, the method comprising:

providing the drinking valve assembly of claim 25;

removing the inner member defining the aperture, the inner member providing a first flow rate through the spout outlet with the movable spout in the second position;

replacing the inner member with a second inner member having an aperture, the second inner member providing a second flow rate through the spout outlet with the movable spout in the second position different from the first flow rate provided by the aperture of the removed inner member.

66. The method of claim 65 further comprising removing the second inner member and replacing the second inner member with a third inner member having an aperture, the third inner member providing a third flow rate through the spout outlet with the movable spout in the second position different from the flow rates provided by the removed inner members.

* * * * *

UNITED STATES PATENT AND TRADEMARK OFFICE

CERTIFICATE OF CORRECTION

PATENT NO. : 6,923,337 B2
APPLICATION NO. : 10/648974
DATED : Auguat 2, 2005
INVENTOR(S) : John A. Hession and James J. Britto It is certified that error appears in the above-identified patent and that said Letters Patent is hereby corrected as shown below:

-Cover Page – (56) References Cited Patent "2002/0066741" replace "6/2002" with -- 1/2002 --

-Column 11, Line 39 after "the outer" and before "wall" delete second occurence of "outer"

-Column 14, Line 12 replace "-45" with -- 45 --

Signed and Sealed this

Fifth Day of September, 2006

JON W. DUDAS
*Director of the United States Patent and Trademark Office*